US008447061B2

(12) United States Patent
Lee

(10) Patent No.: US 8,447,061 B2
(45) Date of Patent: May 21, 2013

(54) DUAL EARPHONE USING BOTH BONE CONDUCTION AND AIR CONDUCTION

(75) Inventor: Sang Chul Lee, Goyang-si (KR)

(73) Assignee: Vonia Corporation, Incheon (KR)

( * ) Notice: Subject to any disclaimer, the term of this patent is extended or adjusted under 35 U.S.C. 154(b) by 60 days.

(21) Appl. No.: 13/259,995

(22) PCT Filed: May 29, 2009

(86) PCT No.: PCT/KR2009/002864

§ 371 (c)(1),
(2), (4) Date: Sep. 23, 2011

(87) PCT Pub. No.: WO2010/114195

PCT Pub. Date: Oct. 7, 2010

(65) Prior Publication Data

US 2012/0020501 A1 Jan. 26, 2012

(30) Foreign Application Priority Data

Mar. 30, 2009 (KR) ..... 10-2009-0027144

(51) Int. Cl.
*H04R 25/00* (2006.01)

(52) U.S. Cl.
USPC ..... 381/380; 381/181

(58) Field of Classification Search
USPC ..... 381/151, 326, 328, 380
See application file for complete search history.

(56) References Cited

U.S. PATENT DOCUMENTS

| | | | | |
|---|---|---|---|---|
| 2,681,389 | A * | 6/1954 | Shaper | 381/151 |
| 3,995,113 | A | 11/1976 | Tani | |
| 5,430,803 | A | 7/1995 | Kimura et al. | |
| 5,692,059 | A | 11/1997 | Kruger | |
| 6,456,721 | B1 * | 9/2002 | Fukuda | 381/380 |
| 7,319,773 | B2 * | 1/2008 | Lee et al. | 381/380 |
| 8,340,310 | B2 * | 12/2012 | Ambrose et al. | 381/380 |
| 2007/0133442 | A1 | 6/2007 | Masuda et al. | |
| 2009/0180648 | A1 | 7/2009 | Endo | |
| 2009/0285417 | A1 | 11/2009 | Shin et al. | |

FOREIGN PATENT DOCUMENTS

| | | |
|---|---|---|
| EP | 0671862 B1 | 9/1995 |
| KR | 10-2008-0003627 | 1/2008 |
| KR | 10-2008-0028583 | 9/2009 |
| WO | WO 2008-004272 A1 | 1/2008 |

OTHER PUBLICATIONS

English Abstract of KR 10-2008-0003627, Aug. 2008.
English Abstract of KR 10-2008-0028583, Oct. 2009.
International Search Report of PCT/KR2009/002864, mailed Apr. 30, 2010.

* cited by examiner

*Primary Examiner* — Suhan Ni
(74) *Attorney, Agent, or Firm* — Novick, Kim & Lee, PLLC; Jae Youn Kim

(57) ABSTRACT

Disclosed is an earphone set using both bone conduction and air conduction. The earphone set includes: a dual earphone which allows a user to selectively hear sounds from the front or rear side of the earphone set; a case cover provided at an end of the dual earphone; a cylindrical reinforcing frame assembled on one side of the case cover; a finishing ring mounted on the outer peripheral surface of the cylindrical reinforcing frame; a top cover assembled on one side of the cylindrical reinforcing frame and the finishing ring and having an extension projection at one side thereof; a rubber ear cap assembled at a front end of the extension projection to be inserted into an ear hole of a user; and a bone conduction vibrator provided inside the dual earphone.

10 Claims, 19 Drawing Sheets

DUAL EARPHONE USING BOTH BONE CONDUCTION AND AIR CONDUCTION

TECHNICAL FIELD

The present invention is an earphone set that uses both bone conduction and air conduction to provide sound. This earphone set inserts into the ear hole of the user from the front side or the rear side to allow the user to hear sounds. It uses a vibrating plate for bone conduction and a PCB for both bone conduction and air conduction that results in 30 to 50 percent of sounds heard through the eardrum using air conduction. The other 50 to 70 percent of the sounds transfer through bone conduction. The earphones can incline to its front side by a determined angle to be comfortably inserted into the ear hole of the user. This improves efficiency by improving the structure of the bone conduction vibrator, and that enhances the quality and reliability of the product for the consumer.

BACKGROUND ART

An earphone or ear bud is a small device inserted into the ear and converts an electric signal into a sound signal. It can be used to hear sounds alone using a portable radio set, a hearing aid, or a music listening device.

However, earphones in the current market only allow sounds to be heard in one direction. These headphones do not use bone conduction and air conduction together, and are not comfortable when inserted into the ear hole of the user.

Meanwhile, a person can listen to sounds using two types of principles, air conduction and bone conduction. Air conduction is a principle in which sounds transfer to the inner ear through the eardrum via air media. Bone conduction transfers sounds to the cochlea through the cranial bone and reaches the brain via acoustic nerves.

Bone conduction is based on the principle that sounds are heard through the vibration of the cranial bone of the user. A bone conduction transducer has been developed on the principle of bone conduction.

The bone conduction transducer is a transducer that converts an electric signal into a vibration signal. Using the principle of bone conduction, the position where a user can hear the optimal sounds is as follows. Accordingly, bone conductive headsets and headphones have been invented.

If a bone conduction headset or headphone is used, the auditory sense of a user is never damaged even when used for long periods of time. However, existing air conduction headsets can show its original function only when it is accurately attached to an ear of a user. Moreover, when it is used for high frequency sounds for a long time, the auditory sensor of the user can be seriously damaged.

On the other hand, since a bone conduction headset or headphone enables hearing of sounds through vibration of the cranial bone of a user, the auditory sense of the user is never damaged even when used for long periods of time. Moreover, since the bone conduction headset does not cover the ear of the user, it is also more comfortable to wear.

Various applied products may result in more convenience in the lives of users. That is, the application areas may been widened to application fields such as tactical products as well as communication devices for aurally handicapped persons, multi-media appliance products, and products for VoIPs, mobile phones, and telephones.

Moreover, a user can perform clear transmission and reception through the headsets even in noisy environments more than 90 dB. When carrying the headset as earplugs, noise sensitivity is reduced by more than 20 dB, and exact reception sensitivity may be obtained even in noisy environments.

The foregoing bone conduction technology is very valuable, and was suggested in the invention of a previous application of the applicant.

Namely, referring to FIGS. 1(*a*) and 1(*b*), a speaker using bone conduction is disclosed in Korean Patent Application No. 2008-0028583.

In the shock absorbing unit of the patent application, an upper case 101 and a lower case 106 are engaged with upper and lower ends of a shaft 103, respectively. A vibrating plate 104, a weighting plate 102, a yoke 105, a magnet 112, and an inner plate 109 are connected to the outer peripheral surface of the shaft housing 108 into which the shaft 103 is inserted. A filler 113, i.e. silicone is filled in an aperture between the shaft 103 and the shaft housing 108. Second and first shaft engaging holes 101*a* and 106*a* are respectively formed in the upper and lower cases 101 and 106, and upper and lower ends of the shaft 103 are inserted into the second and first engaging holes 101*a* and 106*a* respectively. Fifth, fourth, third, second, and first shaft housing engaging holes 104*a*, 102*a*, 105*a*, 112*a*, and 109*a* are respectively formed in the vibrating plate 104, the weighting plate 102, the yoke 105, the magnet 112, and the inner plate 109 inserted into the outer peripheral surface of the shaft housing 108. A coating layer preventing penetration of water and foreign substances is provided in a region where the shaft 103 and the upper and lower cases 101 and 106 are engaged with each other. A frequency range controller 100*a* constitutes a magnetic field circuit that provides a robust vibrating force in a frequency band ranging 100 to 250 Hz according to the weight alteration of the weighting plate 102. Reference numeral 107 represents a printed circuit board (PCB).

Existing bone conduction speakers may be resistant to a strong shock and show a robust vibrating force. However, in this bone conduction speaker a chamber is not formed at the outer corner of the yoke 105, so a spring touch cannot be prevented during a bass sound.

In the existing bone conduction speaker, since the shaft 103 and the lower case 106 are not formed integrally, if a shock occurs, centering is not maintained so that it cannot act as a vibrator.

Moreover, since the existing bone conduction speaker does not include a piezoelectric element, it cannot play back high frequency sounds.

DISCLOSURE OF INVENTION

Technical Problem

The present invention has been made in view of the above problems, and the present invention provides an earphone set that can be selectively inserted into an ear hole of the user from the front side or the rear side to allow the user to hear sounds, that can use a vibrating plate for bone conduction. It uses a PCB for both bone conduction and air conduction so that 30 to 50 percent of sounds can be heard through an eardrum using air conduction. The other 50 to 70 percent of the sounds can be heard using bone conduction. They were designed with human engineering by inclining its front side to a determined angle so it can be comfortably inserted into an ear hole of the user. This improves efficiency by improving the structure of a bone conduction vibrator, and that can show a good image to a consumer by remarkably enhancing the quality and reliability of the product.

Technical Solution

In accordance with one aspect of the present invention, there is provided an earphone set using both bone conduction and air conduction, including: a dual earphone allowing a user to selectively hear sound from the front or rear side of the earphone set; a case cover provided at an end of the dual earphone; a cylindrical reinforcing frame assembled on one side of the case cover; a finishing ring mounted on an outer peripheral surface of the cylindrical reinforcing frame; a top cover assembled on one side of the cylindrical reinforcing frame and the finishing ring and having an extension projection at one side thereof; a rubber ear cap assembled at a front end of the extension projection to be inserted into an ear hole of a user; and a bone conduction vibrator provided inside the dual earphone.

ADVANTAGEOUS EFFECTS

As described above, the present invention provides an earphone set that can be selectively inserted into an ear hole of the user from the front side or the rear side to allow the user to hear sounds, that can use a vibrating plate for bone conduction and uses a PCB for both bone conduction and air conduction so that 30 to 50 percent of sounds can be heard through an eardrum using air conduction and 50 to 70 percent of the sounds can be heard using bone conduction, that can be designed using human engineering by inclining its front side by a determined angle so as to be comfortably inserted into an ear hole of the user, that can improve efficiency by improving the structure of a bone conduction vibrator, and that can show a good image to a consumer by remarkably enhancing the quality and reliability of the product.

BRIEF DESCRIPTION OF DRAWINGS

The above and other aspects and features of the invention will become apparent from the following description of preferred embodiments given in conjunction with the accompanying drawings, in which.

BEST MODE FOR CARRYING OUT THE INVENTION

After this point, exemplary embodiments of the invention will be described in detail with reference to the accompanying drawings. Dual earphones using both bone conduction and air conduction according to the exemplary embodiments of the invention are illustrated in FIGS. 3 to 20.

In the description of the invention, a detailed description of related known structures and functions will be omitted to avoid obscuring the scope of the present invention.

The terms used below are defined considering their functions in the invention, and may become different according to intentions and practices of a user or a manager. Therefore, the definitions of the terms should be construed on the basis of the contents of the overall specification.

Figure 1:
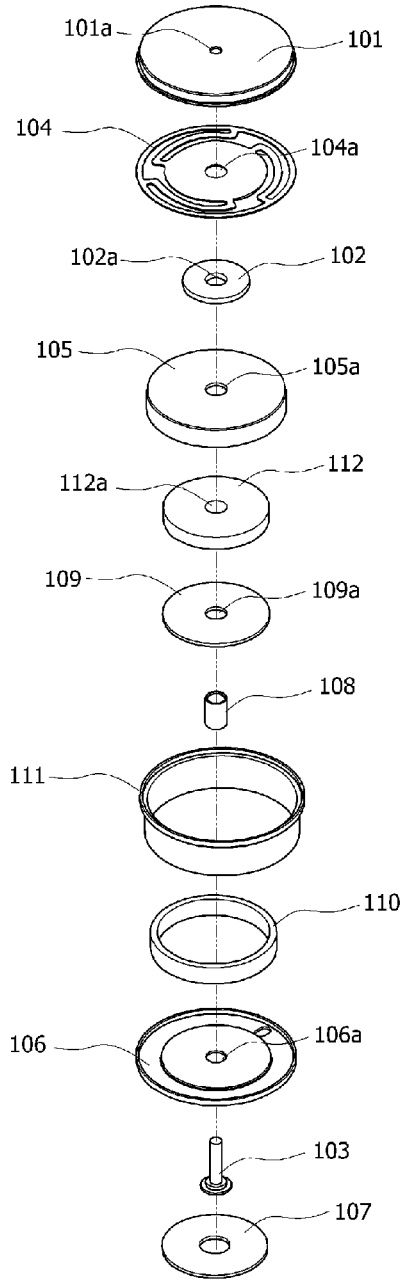
FIG. 1 is an exploded perspective view illustrating an existing speaker using bone conduction.
Figure 2:
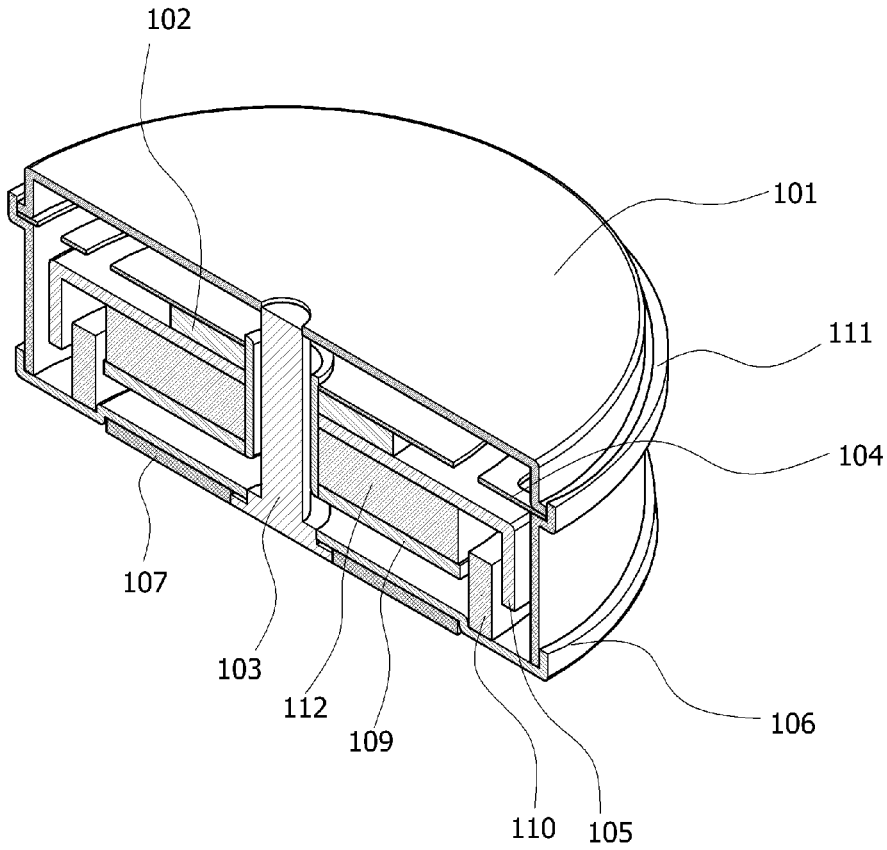
FIG. 2 is a sectional perspective view illustrating an existing speaker using bone conduction.
Figure 3:
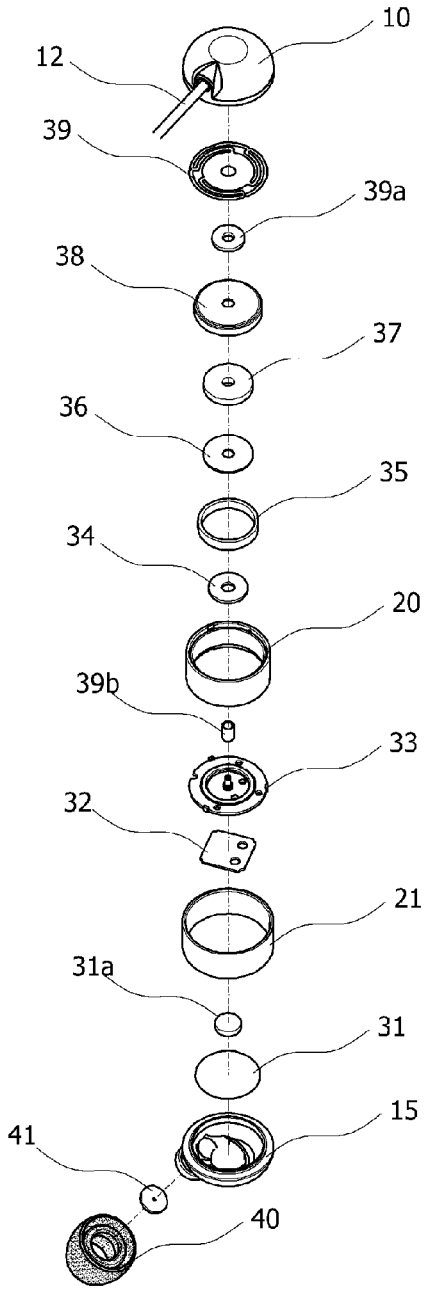
FIG. 3 is an exploded perspective view illustrating a dual earphone using bone conduction and air conduction according to an embodiment of the invention.
Figure 4:
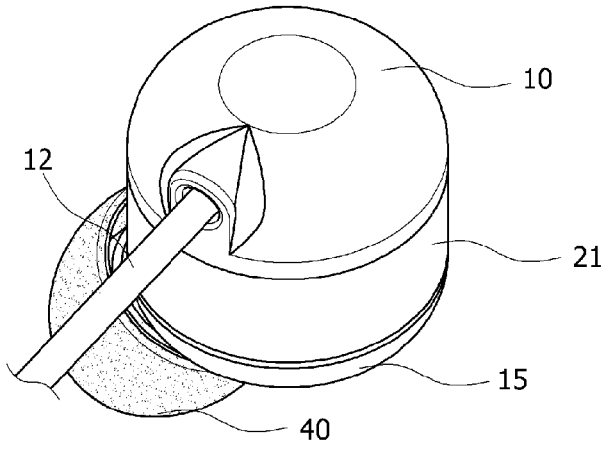
FIG. 4 is a perspective view illustrating the dual earphone of FIG. 3.
Figure 5:
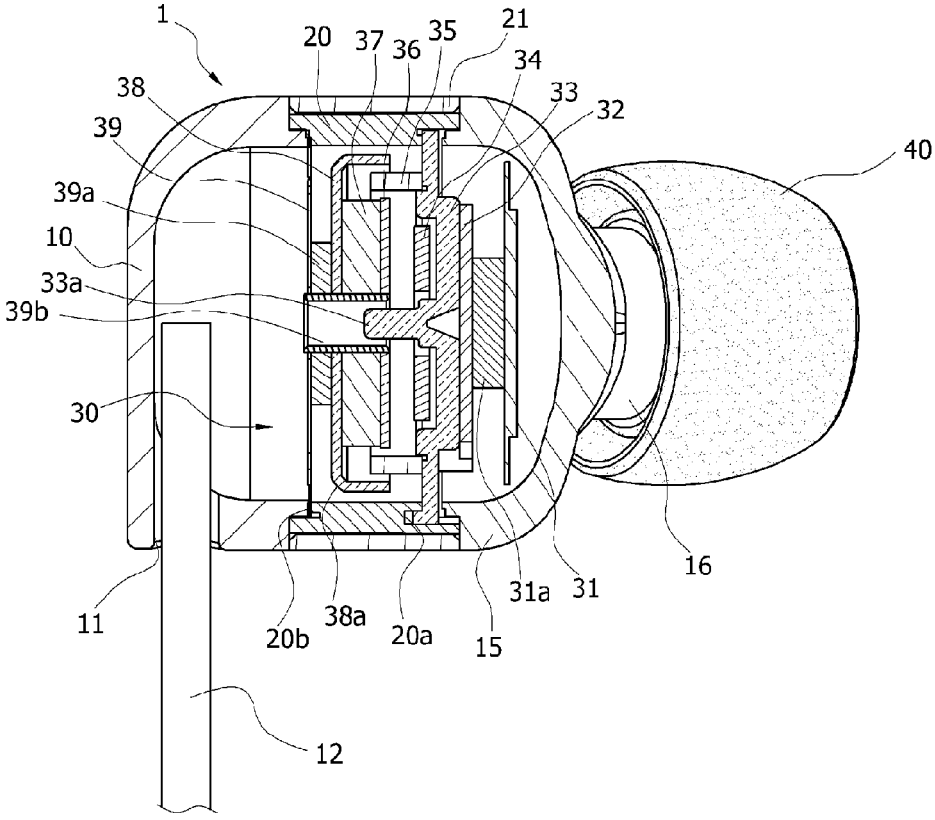
FIG. 5 is an enlarged side sectional view illustrating the dual earphone of FIG. 4.

First, referring to FIGS. 3 and 5, an earphone set according to the first embodiment of the present invention includes a dual earphone 1 allowing a user to selectively hear sounds from a front or rear side of an ear.

A case cover 10 is provided at an end of the dual earphone 1. A hole 11 is formed on one side of the case cover 10 so that a cable 12 is inserted into the hole 11.

A cylindrical reinforcing frame 20 is assembled on one side of the case cover 10. A finishing ring 21 is mounted on an outer peripheral surface of the cylindrical reinforcing frame 20.

Figure 6:
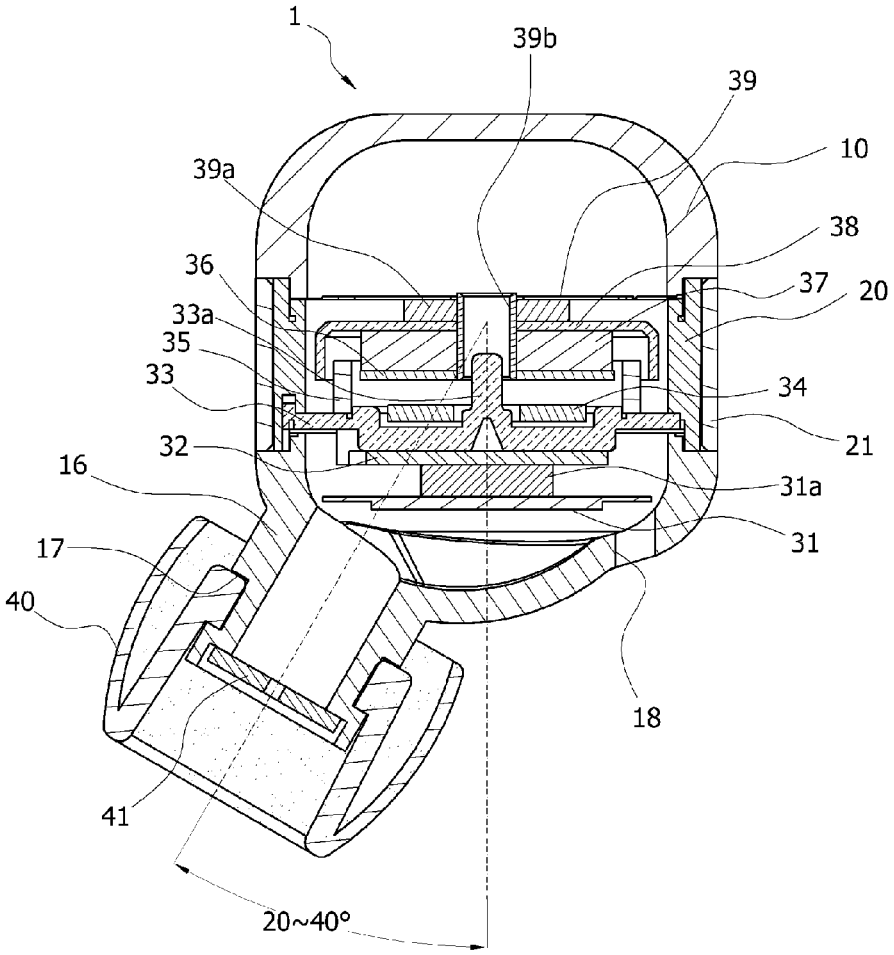
FIG. 6 is an enlarged plan cross-sectional view illustrating the dual earphone of FIG. 4.
Figure 7:
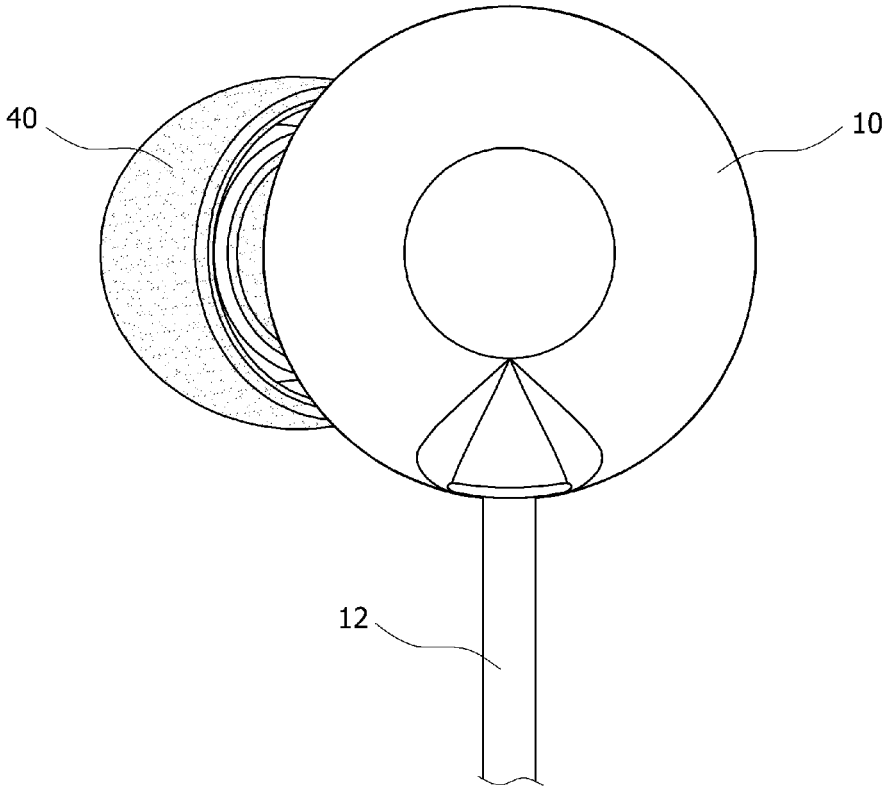
FIG. 7 is a plan view illustrating the dual earphone of FIG. 4.
Figure 8:
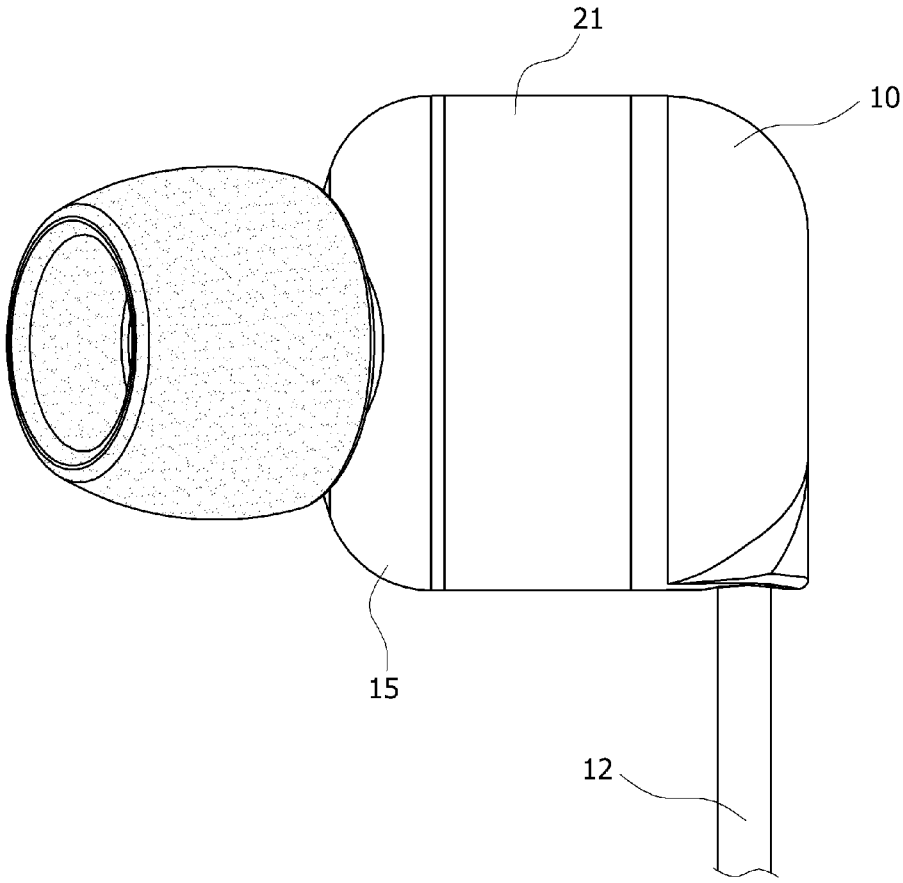
FIG. 8 is a left side view illustrating the dual earphone of FIG. 4.
Figure 9:
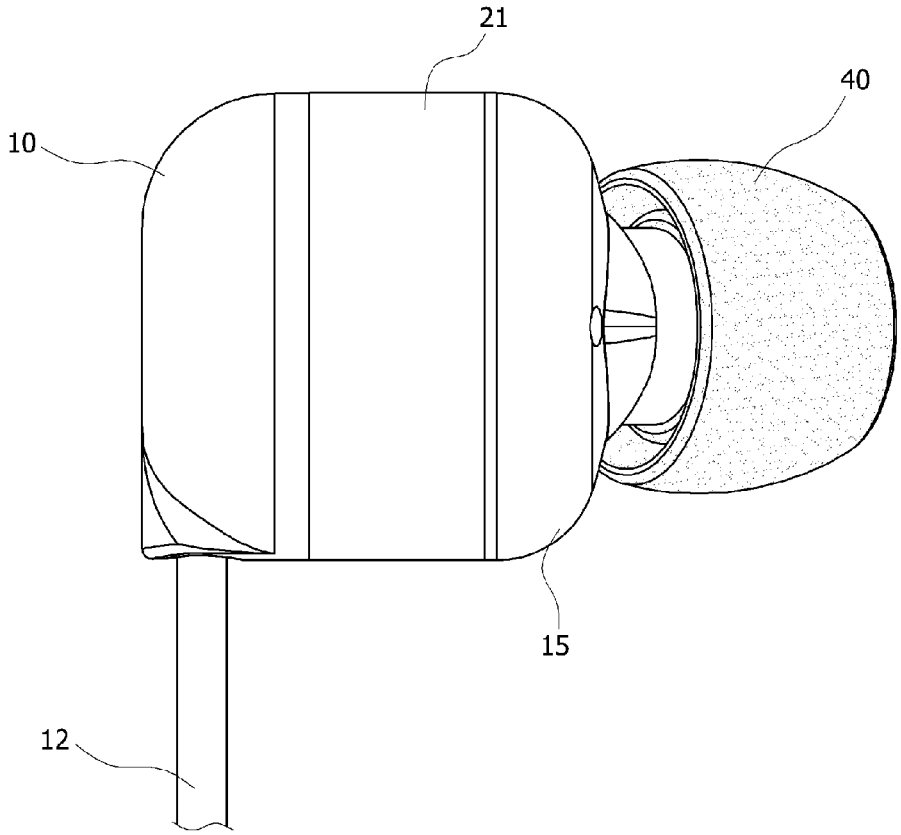
FIG. 9 is a right side view illustrating the dual earphone of FIG. 4.
Figure 10:
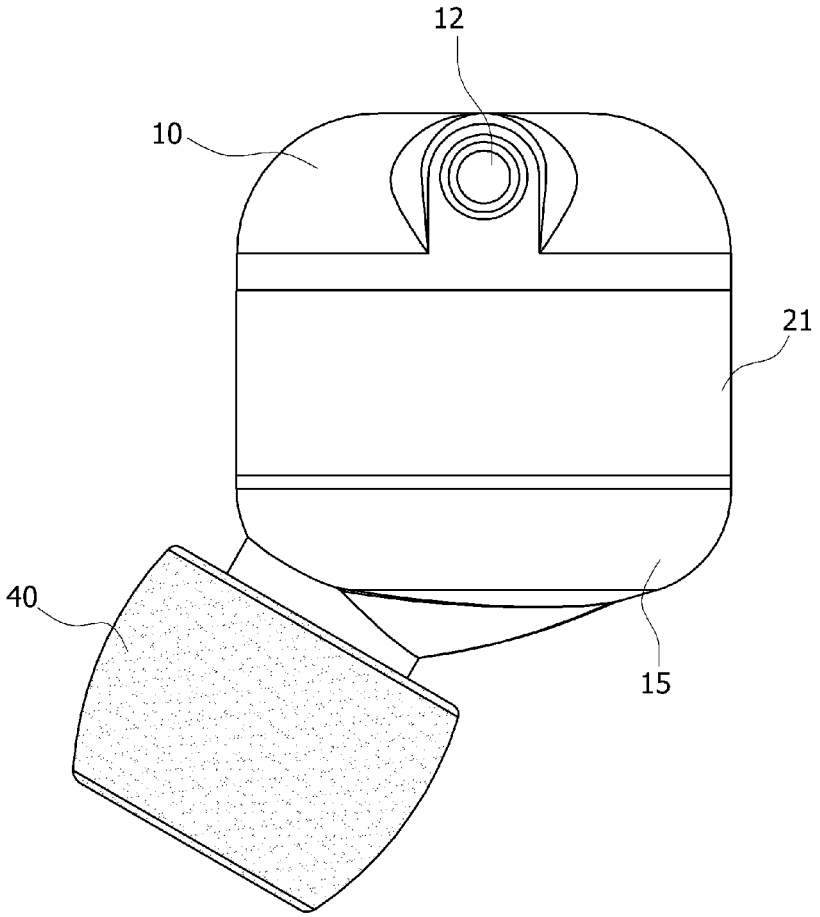
FIG. 10 is a front view illustrating the dual earphone of FIG. 4.
Figure 11:
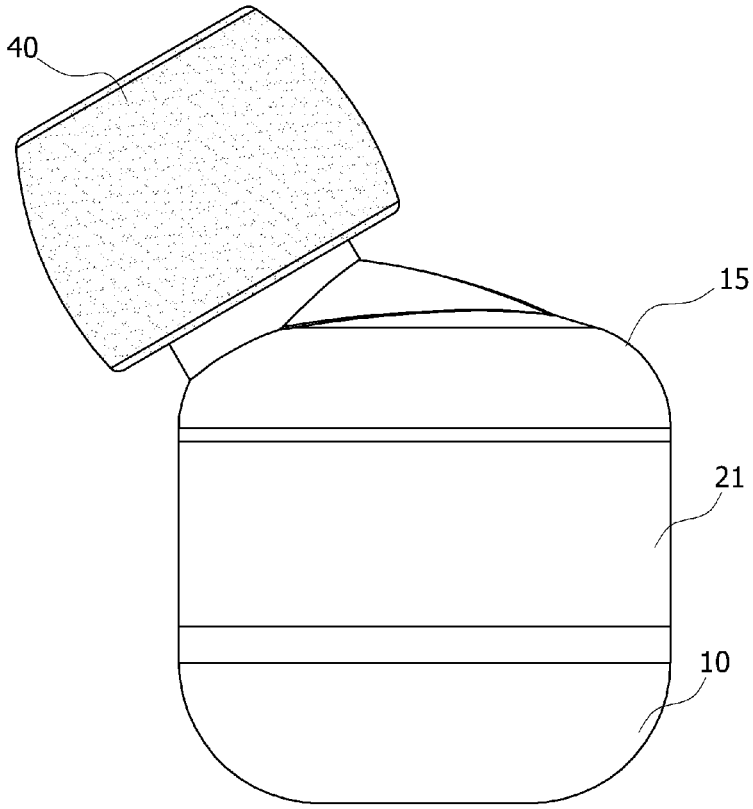
FIG. 11 is a rear view illustrating the dual earphone of FIG. 4.
Figure 12:
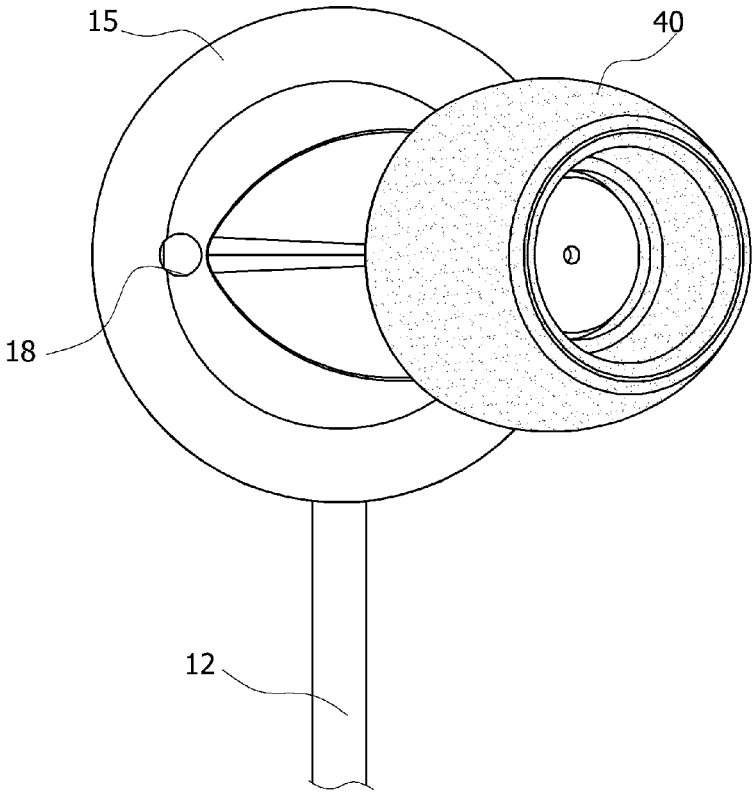
FIG. 12 is a bottom view illustrating the dual earphone of FIG. 4.
Figure 13:
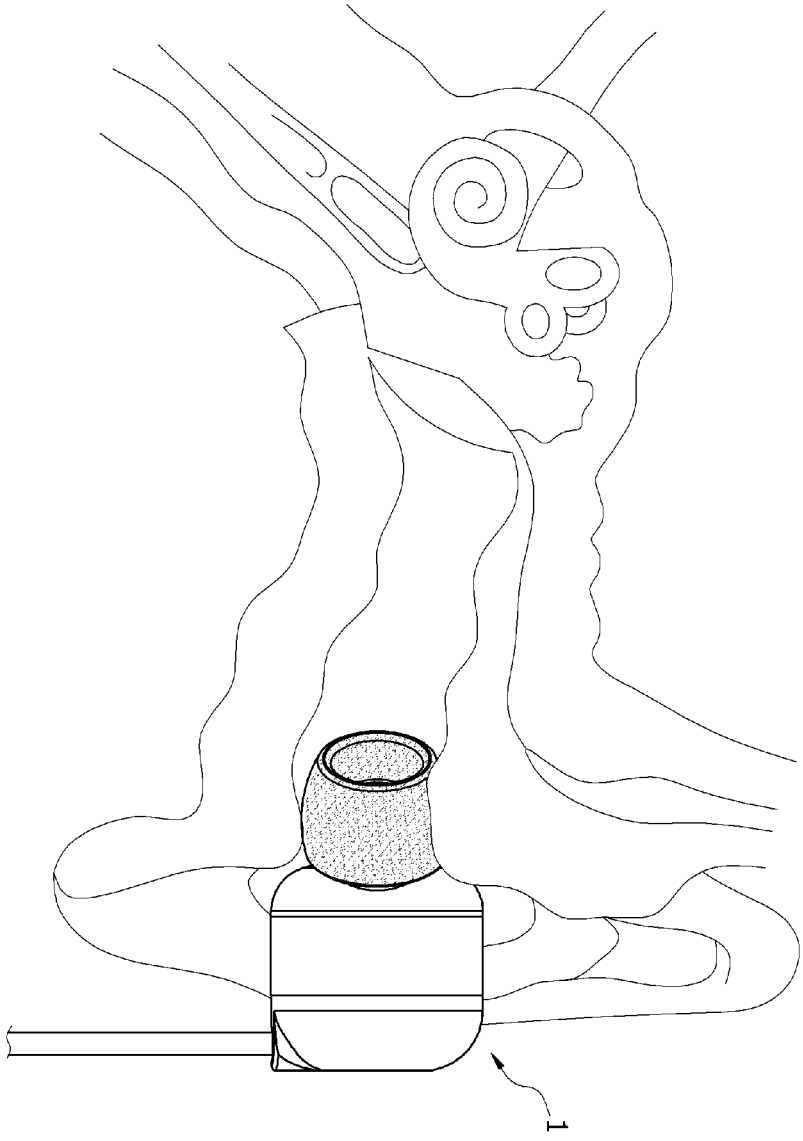
FIG. 13 is a view illustrating a dual earphone of FIG. 3 inserted from its front side to allow a user to hear sounds.

Referring to FIG. 6, a top cover 15 is assembled on one side of the cylindrical reinforcing frame 20 and the finishing ring 21, and an extension projection 16 is provided on one side of the top cover 15.

Then, the extension projection 16 is preferably inclined by an angle ranging from 20 to 40 degrees from a body center of the dual earphone 1 so that the dual earphone 1 is easily inserted into an ear hole. However, the inclined angle of the extension projection 16 may be increased or reduced if necessary.

A locking groove 17 is formed on an outer peripheral surface of the extension projection 16 to prevent the rubber ear cap 40 from being easily separated from the front end of the extension projection 16 after the rubber ear cap 40 is assembled.

The earphone set according to the embodiment of the present invention includes the rubber ear cap 40 assembled at a front end of the extension projection 16 to be inserted into an ear hole of the user. The rubber ear cap 40 is preferably made of a soft material to prevent pain in the ear hole of the user.

In the embodiment of the present invention, a damper ear cap 41 is assembled at a front end of the extension projection 16, and a hole is formed at the center of the damper ear cap 41 so that the user hears sounds using air conduction.

In the embodiment of the present invention, at least one vent hole 18 is further formed in the top cover 15 so that the user hears sounds using both bone conduction and air conduction.

In the embodiment of the present invention, a bone conduction vibrator 30 is provided inside the dual earphone 1 such that the dual earphone 1 uses both bone conduction and air conduction.

Referring to FIGS. 5 and 6, the bone conduction vibrator includes a bottom cover 33 assembled on an inner peripheral surface of the cylindrical reinforcing frame 20, and a shaft 33*a* integrally protrudes from a center of the bottom cover 33.

Further, an inside cushion 34 is mounted on an outer peripheral surface of the shaft 33*a*, and a voice coil 35 is assembled at an end of the bottom cover 33.

A yoke 38 is assembled on a center shaft 39*b* at an outer peripheral surface of the voice coil 35, and a chamfering portion 38*a* is formed at a corner of the yoke 38.

A magnet 37 and a plate 36 are assembled inside the yoke 38 and on an outer peripheral surface of the center shaft 39*b* respectively.

A weight plate 39*a* and a vibrating plate 39 are provided on sides of the yoke 38 and the outer peripheral surface of the center shaft 39*b* respectively.

A printed circuit board (PCB) 32, a piezoelectric damper 31*a*, and a piezoelectric element 31 are sequentially assembled on sides of the inside cushion 34.

In the embodiment of the present invention, a catching groove 20*a* and a support protrusion 20*b* are further formed on sides of the frame 20, respectively. The catching groove 20*a* prevents a bottom cover 33 inserted into one side of the frame 20 from being separated to the outside, and the support protrusion 20*b* prevents a vibrating plate 39 inserted into the other side of the frame 20 from being separated to the outside.

While the invention has been shown and described with respect to the exemplary embodiment, it will be understood by those skilled in the art that various changes and modifications may be made without departing from the spirit and scope of the invention as defined in the following claims.

The functioning and effects of the earphone set using bone conduction and air conduction according to the first embodiment of the invention will be now described.

The earphone set can be selectively inserted into an ear hole of the user from the front side (FIG. 13) or the rear side (FIG. 14) to allow the user to hear sounds, can use a vibrating plate for bone conduction and uses a PCB for both bone conduction and air conduction so that 30 to 50 percent of sounds can be heard through an eardrum using air conduction and 50 to 70 percent of the sounds can be heard using bone conduction, can be designed using human engineering by inclining its front side by a determined angle so as to be comfortably inserted into an ear hole of the user, and can improve efficiency by improving the structure of a bone conduction vibrator, and that can show a good image to a consumer by remarkably enhancing the quality and reliability of the product.

Referring to FIG. 3, the case cover 10 and the top cover 15 are assembled on one side and the opposite side of the frame 20 and the finishing ring 21 to assemble the earphone set according to the embodiment of the invention. A bone conduction vibrator 30 is installed inside the dual earphone 1.

The bone conduction vibrator 30 is installed as illustrated in FIG. 5. The bottom cover 33 is mounted on the catching groove formed on the inner peripheral surface of one side of the frame 20 to be firmly assembled, thereby preventing its separation to the outside.

Then, the shaft 33*a* integrally protrudes from the center of the bottom cover 33. Accordingly, upon being shocked, the bottom cover 33 remains centered. As a result, even after the bottom cover 33 is used for a long time, its chance of becoming defective may be reduced.

Furthermore, since the vibrating plate 39 is firmly inserted into a support protrusion 20*b* formed on an inner peripheral surface of the frame 20, even after the vibrating plate 39 is operated for a long time, separation of the vibrating plate 39 may be prevented.

In addition, a chamfering portion 38 forms a determined angle from a corner of the yoke 38. The chamfering portion 38 touches the vibrating plate 39 during a bass sound, thereby preventing occurrence of abnormal sounds.

That is, when the chamfering portion 38 does not form a determined angle from a corner of the yoke 38, if the corner portion with a predetermined angle due to upward, downward, left, and right operations touches the vibrating plate 39 during a bass sound, abnormal sounds occur frequently. However, the present invention may resolve such a problem.

In the embodiment of the present invention, a piezoelectric element 31 is formed at an end of the bone conduction vibrator 30 to reproduce high frequency sounds of the earphone set.

That is, the piezoelectric element 31 is attached to a damper piezoelectric element 31*a* on one side of the PCB 32 to form the bone conduction vibrator 30 and the piezoelectric element 31 in a module. In particular, insufficiently high frequency sounds of the bone conduction vibrator 30 greater than 3 to 20 k are compensated by the piezoelectric element 31 to allow the user to hear all bands of sounds. As a result, the piezoelectric element 31 functions to reproduce insufficiently high frequency sounds.

Meanwhile, a user may selectively insert the earphone set into an ear hole on sides of the top cover 15 and the rubber ear cap 40 (FIG. 18), or on a side of the case cover 10 (FIG. 19) in opposite directions to hear sounds.

Figure 18:
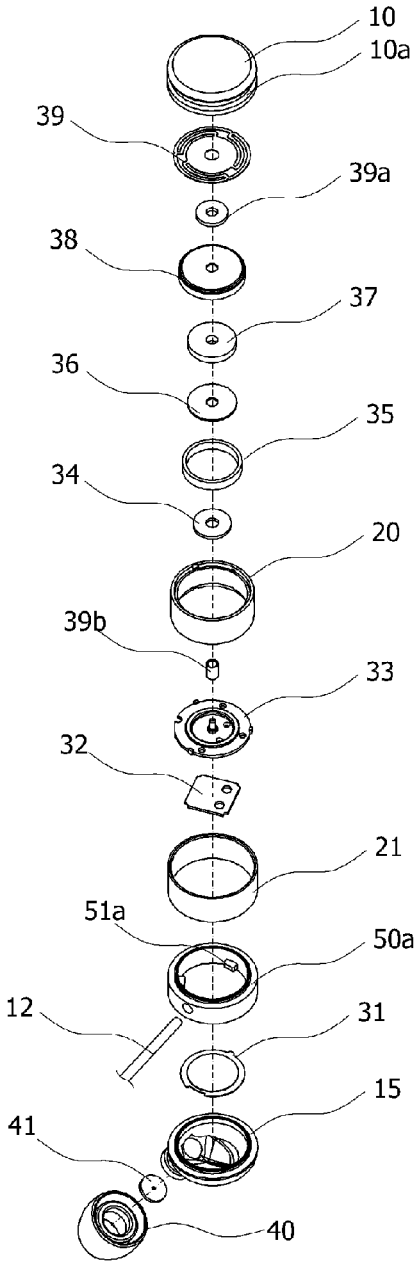
FIG. 18 is an exploded perspective view illustrating a dual earphone using bone conduction and air conduction according to still another embodiment of the invention.

Accordingly, the user hears sounds from a side of a vibrating plate 39 of the earphone set using bone conduction and from a side of the PCB 32 using both bone conduction and air conduction. Referring to FIG. 18, the earphone set can use a vibrating plate for bone conduction and uses a PCB for both bone conduction and air conduction so that 30 to 50 percent of sounds can be heard through an eardrum using air conduction and 50 to 70 percent of the sounds can be heard using bone conduction.

Further, in the embodiment of the invention, referring to FIG. 6, the earphone set can be designed using human engineering by inclining its front side by a determined angle so as to be comfortably inserted into an ear hole of the user. In this case, the extension projection is inclined at an angle ranging from 20 to 40 degrees from the center of a body of the dual earphone 1 so that the user may easily use the dual earphone 1.

Figure 15:
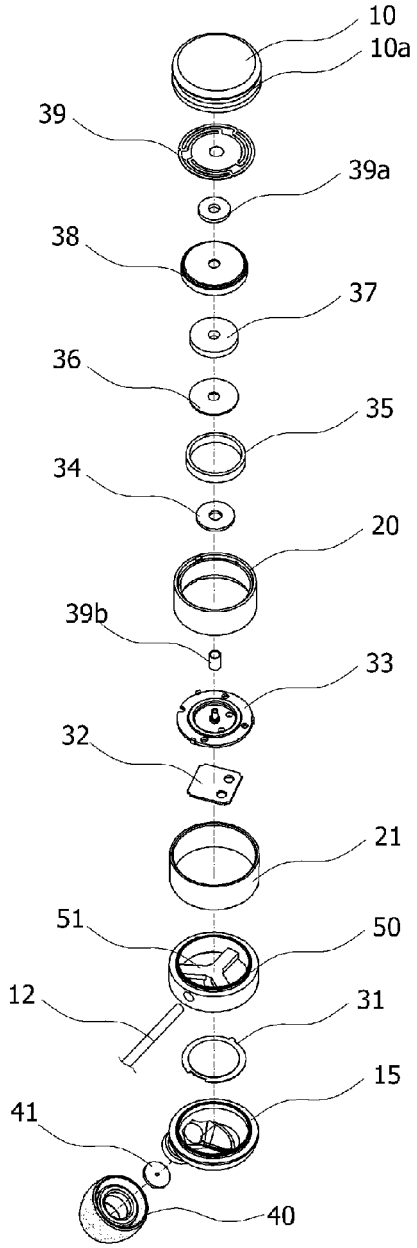
FIG. 15 is an exploded perspective view illustrating a dual earphone using both bone conduction and air conduction according to another embodiment of the invention.
Figure 16:
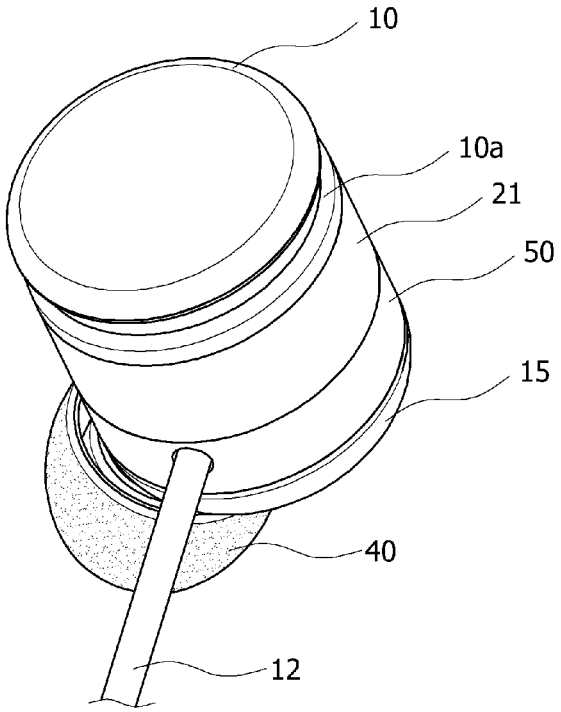
FIG. 16 is a perspective view illustrating the dual earphone of FIG. 15.
Figure 19:
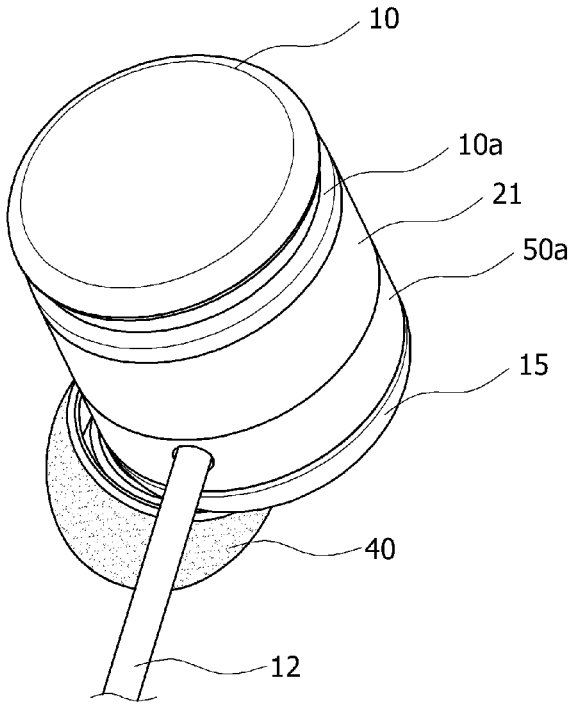
FIG. 19 is a perspective view illustrating the dual earphone of FIGS. 18.
Figure 20:
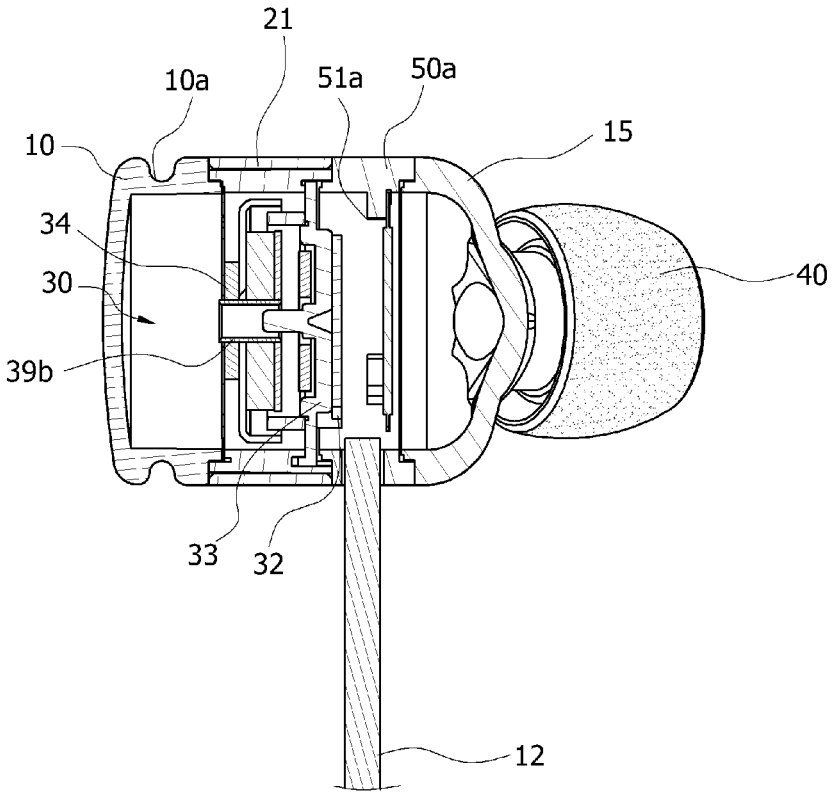
FIG. 20 is an enlarged side sectional view illustrating the dual earphone of FIG. 19.

Meanwhile, the second embodiment of the present invention will be described in detail with reference to FIGS. 15 to 17, and the third embodiment of the present invention will be described in detail with reference to FIGS. 18 to 20.

That is, instead of providing a hole 11 and a cable 12 in the case cover 10, a groove 10*a* may be formed on an outer peripheral surface of the case cover 10 so that it is caught in an ear hole of a user.

Furthermore, first and second piezoelectric module cases 50 and 50*a* are disposed between the finishing ring 21 and the top cover 15, and a cable 12 is inserted into the first and second piezoelectric module cases 50 and 50*a* to attach a piezoelectric element 31.

Then, a first piezoelectric fixture 51 fixing the center of the piezoelectric element 31 and a second piezoelectric fixture 51 a fixing an outer peripheral surface of the piezoelectric element 31 are disposed at outer peripheral surfaces of the first and second piezoelectric module cases 50 and 50*a*.

The remaining technical constructions of the second and third embodiments of the present invention are identical with that of the first embodiment, and a detailed description thereof will be omitted.

The operations of the second and third embodiments of the present invention configured as above are as follows. The same operations and effects of the first and second embodiments as those of the first embodiment will be omitted.

The second embodiment of the present invention functions to make and activate a middle band of sounds.

Figure 17:
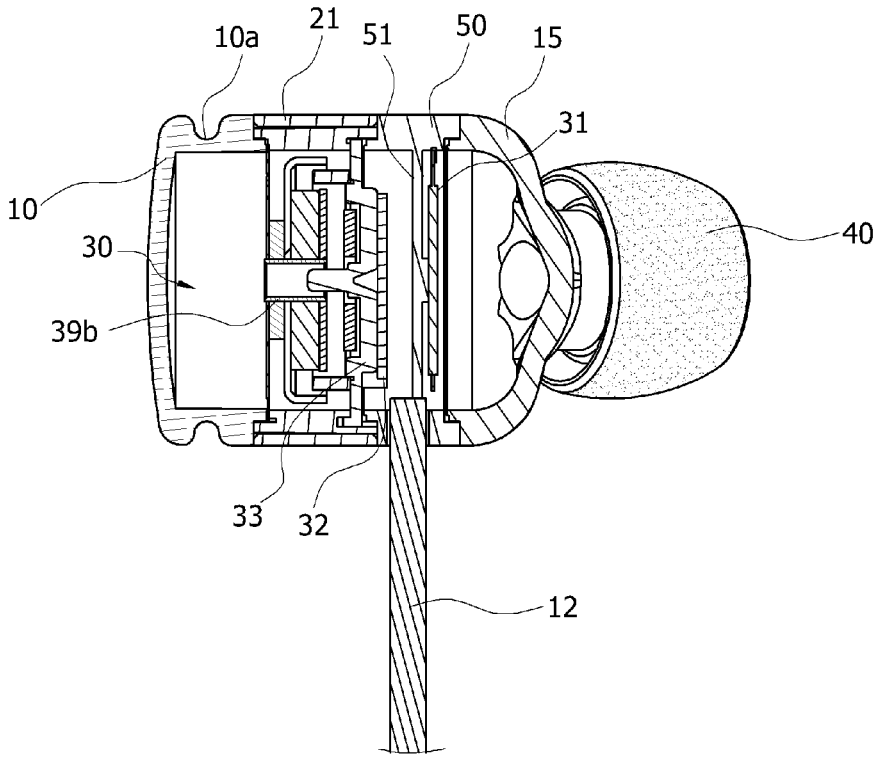
FIG. 17 is an enlarged side sectional view illustrating the dual earphone of FIG. 16.

That is, referring to FIG. 17, a piezoelectric element 31 is provided at the center of the first piezoelectric fixing member 51 having a tripod-like shape inside the first piezoelectric module case 50. When the piezoelectric element 31 is vibrated by an electric signal, since the center of the first piezoelectric element fixing member 51 is fixed, its outer portion is shaken, thereby generating and improving a middle band of sounds.

The third embodiment of the present invention functions to make and activate a high band of sounds.

Figure 14:
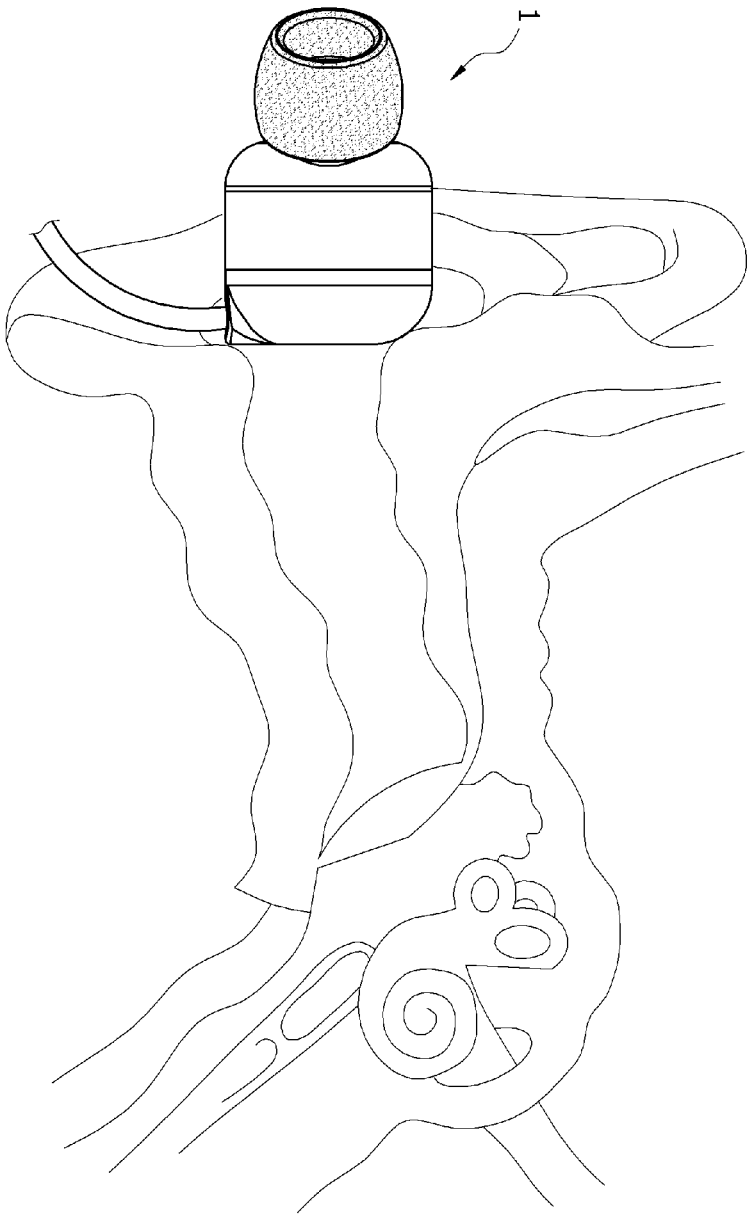
FIG. 14 is a view illustrating a dual earphone of FIG. 3 inserted from its rear side to allow a user to hear sounds.

That is, as shown in FIG. 14, in the second piezoelectric fixture 51 a provided inside the second piezoelectric module case 50*a*, an outer part thereof is left and the center thereof is cut, with an outer portion of the piezoelectric element 31 being fixed.

In this state, when the piezoelectric element 31 is vibrated by an electric signal, since an outer portion of the second piezoelectric element fixing member 51*a* is fixed, the center thereof is shaken, thereby generating and improving a high band of sounds.

The technical spirit of an earphone set using bone conduction and air conduction can be repeatedly carried out and can expedite technical development, contributing to industry development.

The invention claimed is:

1. An earphone set using both bone conduction and air conduction, comprising:

a dual earphone allowing a user to selectively hear sound from the front or rear side of the earphone set;

a case cover provided at an end of the dual earphone;

a cylindrical reinforcing frame assembled on one side of the case cover;

a finishing ring mounted on an outer peripheral surface of the cylindrical reinforcing frame;

a top cover assembled on one side of the cylindrical reinforcing frame and the finishing ring and having an extension projection at one side thereof;

a rubber ear cap assembled at a front end of the extension projection to be inserted into an ear hole of a user; and a bone conduction vibrator provided inside the dual earphone.

2. The earphone set according to claim 1, wherein the extension projection is inclined from the center of a body of the dual earphone in a range from 20 to 40 degrees so that the dual earphone is easily inserted into the ear hole of the user.

3. The earphone set according to claim 2, wherein a locking groove is formed on an outer peripheral surface of the extension projection to preventing the rubber ear cap from being easily separated from the front end of the extension projection after the rubber ear cap is assembled.

4. The earphone set according to claim 2, further comprising a damper ear cap provided at a front end of the extension projection and having a hole formed at a center of the damper ear cap so that the user hears sounds using air conduction.

5. The earphone set according to claim 1, wherein at least one vent hole is further formed in the top cover so that the user hears sounds using both bone conduction and air conduction.

6. The earphone set according to claim 1, wherein the bone conduction vibrator includes:

bottom cover assembled on an inner peripheral surface of the cylindrical reinforcing frame, and from which a shaft integrally protrudes from the center of the bottom cover;

n inside cushion mounted on an outer peripheral surface of the shaft to reduce mechanical shock noise;

voice coil assembled at one end of the bottom cover;

a yoke assembled in a center shaft at an outer peripheral surface of the voice coil, and having a chamfering portion formed at a corner of the yoke;

magnet and a plate assembled inside the yoke and on an outer peripheral surface of the center shaft respectively;

weight plate and a vibrating plate assembled on one side of the yoke and on an outer peripheral surface of the center shaft respectively; and printed circuit board, a piezoelectric damper, and a piezoelectric element sequentially assembled on one side of the inside cushion.

7. The earphone set according to claim 6, wherein a catching groove for preventing separation of the inserted bottom cover is further formed on one side of the frame and a support protrusion for preventing separation of the inserted vibrating plate is further formed on an opposite side of the frame.

8. The earphone set according to claim 1, wherein a hole for inserting a cable is formed on one side of the case cover or a groove for preventing separation of the case cover from the ear hole of the user is formed on an outer peripheral surface of the case cover.

9. The earphone set according to claim 1, wherein piezoelectric module cases are disposed between the finishing ring and the top cover to attach and detach a piezoelectric element when a cable is inserted into the piezoelectric module cases.

10. The earphone set according to claim 9, wherein a first piezoelectric element fixing member is formed on an inner peripheral surface of each piezoelectric module case and a second piezoelectric element fixing member fixes an outer peripheral surface of the piezoelectric element.

* * * * *